US006609323B1

(12) United States Patent
Donnelly

(10) Patent No.: US 6,609,323 B1
(45) Date of Patent: Aug. 26, 2003

(54) INTERCHANGEABLE BARREL SYSTEM FOR REVOLVERS

(75) Inventor: Douglas F. Donnelly, Hartford, CT (US)

(73) Assignee: United States Fire-Arms Manufacturing Company, Hartford, CT (US)

( * ) Notice: Subject to any disclaimer, the term of this patent is extended or adjusted under 35 U.S.C. 154(b) by 0 days.

(21) Appl. No.: 10/094,402

(22) Filed: Mar. 8, 2002

Related U.S. Application Data

(60) Provisional application No. 60/274,794, filed on Mar. 9, 2001.

(51) Int. Cl.[7] ..... F41A 21/00
(52) U.S. Cl. ..... 42/75.02; 42/59
(58) Field of Search ..... 42/59, 75.02

(56) References Cited

U.S. PATENT DOCUMENTS

| | | | | | |
|---|---|---|---|---|---|
| 158,957 | A | | 1/1875 | Mason | |
| 2,150,914 | A | * | 3/1939 | Gaidos | 42/59 |
| 2,238,587 | A | * | 4/1941 | Gaidos | 42/59 |
| 2,329,273 | A | * | 9/1943 | Kelly | 42/62 |
| 2,976,638 | A | * | 3/1961 | Owens | 42/77 |
| 3,280,495 | A | * | 10/1966 | Lewis | 42/59 |
| 4,288,938 | A | | 9/1981 | Kahn | 42/59 |
| 4,297,801 | A | | 11/1981 | Kahn | 42/59 |
| 4,316,339 | A | * | 2/1982 | Herriott | 42/59 |
| 4,519,156 | A | * | 5/1985 | Shaw | 42/77 |
| 4,558,530 | A | * | 12/1985 | de Witt | 42/59 |
| 4,651,456 | A | * | 3/1987 | Ghisoni | 42/62 |
| 5,020,260 | A | | 6/1991 | Houghton | 42/75.02 |
| 5,410,834 | A | * | 5/1995 | Benton et al. | 42/75.02 |
| 5,987,797 | A | | 11/1999 | Dustin | 42/75.02 |

* cited by examiner

*Primary Examiner*—Michael J. Carone
*Assistant Examiner*—Denise Buckley
(74) *Attorney, Agent, or Firm*—Christie, Parker & Hale, LLP

(57) ABSTRACT

The present invention is directed to a revolver, where headspace is achieved differently and separately from the barrel, where [a cartridge is placed in the cylinder] and where that headspace is a function of caliber and varies per caliber/cylinder.

The system of the present invention links a unique barrel and cylinder relationship so that each may be exchanged with the other set on the same frame. A tension ring is used to threadedly engage the interchangeable barrel relative to the interchangeable cylinder and revolver frame such that the predetermined headspace is preserved. And all being fit to differing headspace points within the single revolver frame. Each could be numbered so that confusion of which cylinder with which barrel be reduced.

6 Claims, 12 Drawing Sheets

INTERCHANGEABLE BARREL SYSTEM FOR REVOLVERS

CROSS-REFERENCE TO RELATED APPLICATION

This application claims priority to Provisional Patent Application No. 60/274,794, filed Mar. 9, 2001.

BACKGROUND OF THE INVENTION

The issue of barrel interchangeability was addressed in revolvers but led to a design that was so cumbersome [Dan Wesson design] that is no longer used. This design involved an entire barrel covering or shroud housing and neither the method nor the finished product was successful.

Another preexisting design is the Savage, a rifle design.

In the design of U.S. Pat. No. 5,987,797, headspace is achieved integral to a rifle barrel. Restated, the cartridge resides inside the barrel and is part of same. Therefore no consideration is given to a revolver, which requires the installation of a cylinder of a different caliber when a barrel of different caliber is placed on the gun.

To the extent that a .22 cal. barrel may be placed on the revolver frame while the frame continues to hold a .45 cal. cylinder, a most dangerous and possibly fatal situation would occur.

SUMMARY OF THE INVENTION

The present invention is directed to a revolver, wherein headspace is achieved differently and separately from the barrel [a cartridge is placed in the cylinder] and wherein that headspace is a function of caliber and varies per caliber/cylinder.

The system of the present invention links a unique barrel and cylinder relationship so that each may be exchanged with the other set on the same frame, and all being fit to differing headspace points within the single revolver frame. Each barrel and cylinder could be numbered to reduce confusion as to which cylinder corresponds with which barrel.

It is therefore desirable to provide for easy exchange of barrel length and caliber for an historic class of pistol using a minimum of parts or modification, and preserving the overall aesthetics of ie historic design.

It is further desirable to provide for easy exchange of barrel length and caliber for single action revolvers wherein different caliber and barrel length combinations are desirable and previously could only be obtained by purchasing a complete gun without the mentioned desirable features. The ability to switch barrel length and caliber gives the shooter ultimate flexibility while maintaining the classic look of the original design. See U.S. Pat. No. 158,957, Mason, William of Hartford, showing the class of fire arm (FIG. 1).

DETAILED DESCRIPTION OF THE INVENTION

Figure 1:
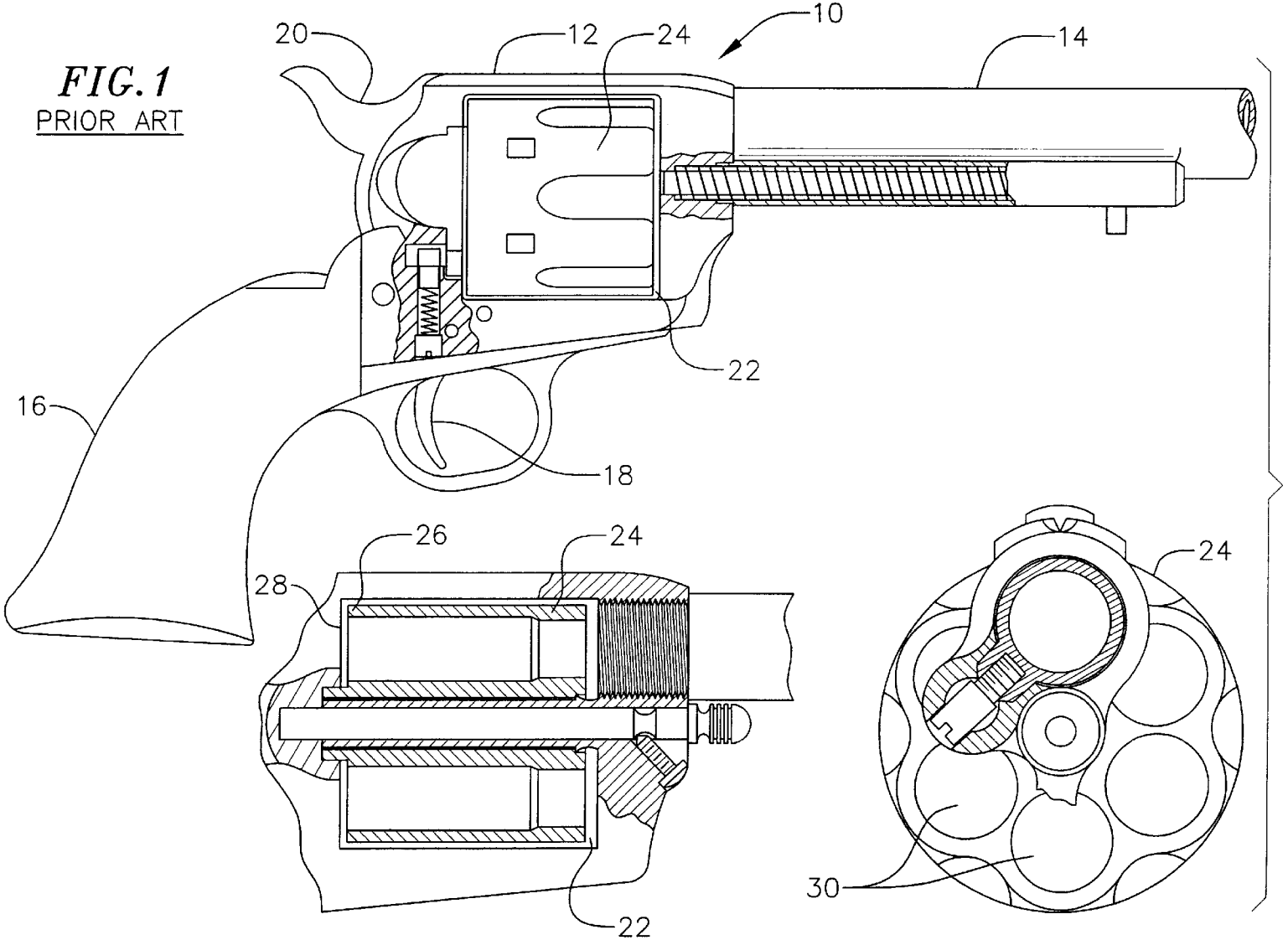
FIG. 1 PRIOR ART
FIG. 1 shows exterior and sectioned views of Mason's design described in U.S. Pat. No. 158,957.
Figure 1A:
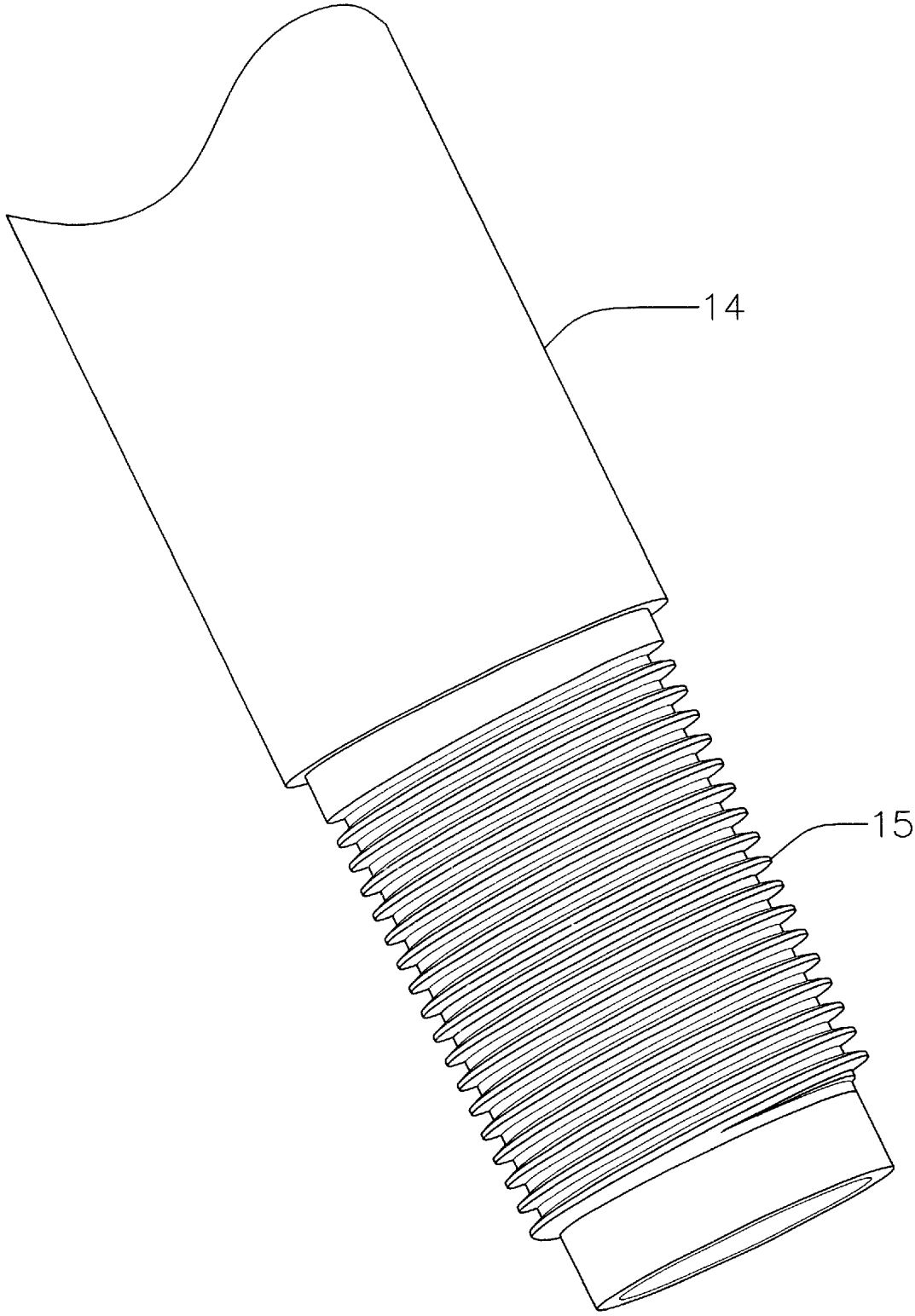
FIG. 1A PRIOR ART
FIG. 1A shows typical view of the barrel of FIG. 1 before installation in frame.
Figure 2:
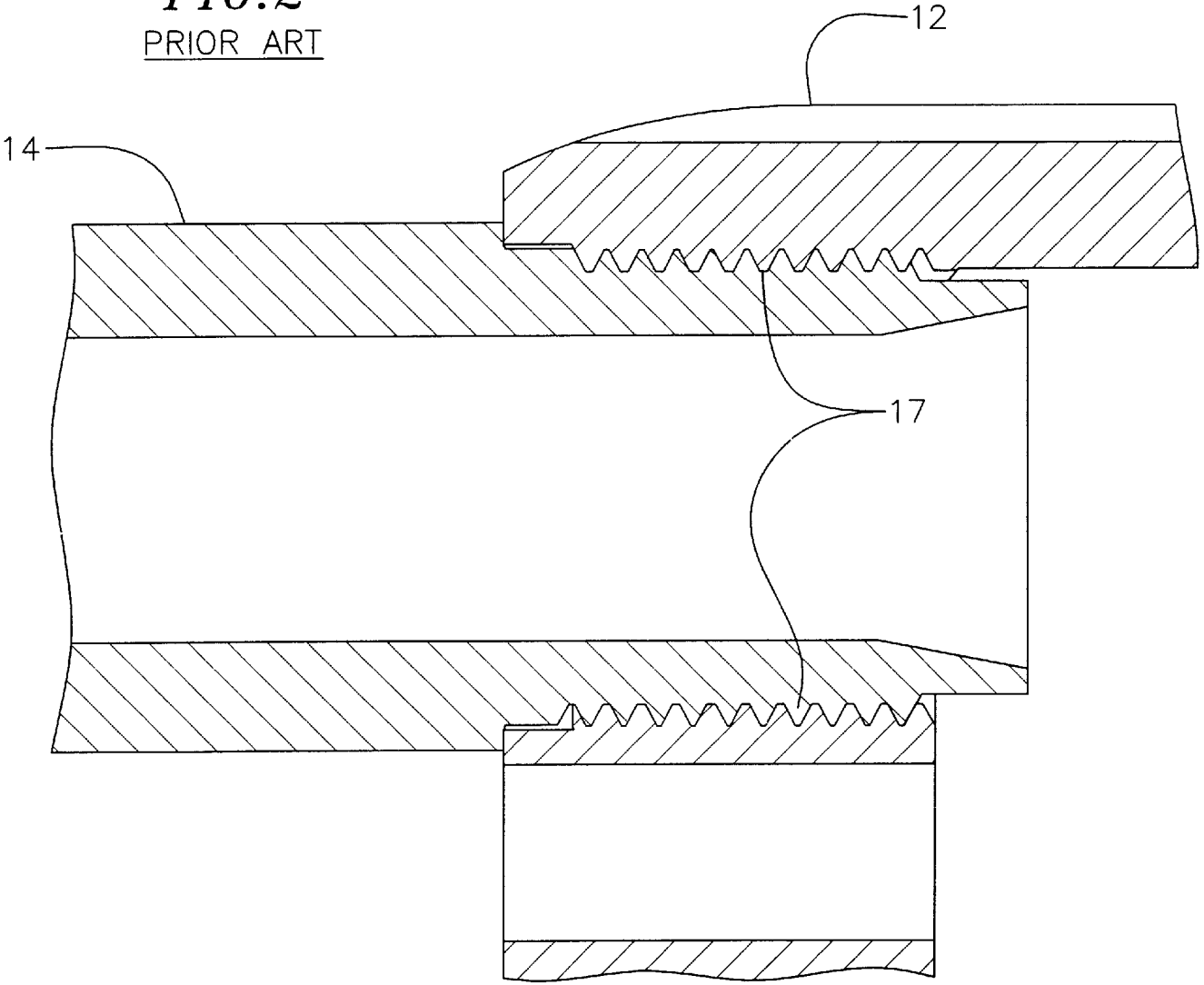
FIG. 2 PRIOR ART
FIG. 2 shows typical sectioned view of Mason's design. Barrel is shown fully installed or turned into the frame.

FIG. 1 generally depicts a single-caliber, fixed-barrel revolver 10 the prior art. The revolver 10 includes a revolver frame 12, a barrel 14 bored to accommodate a particular ammunition caliber, a grip 16, a trigger assembly 18, and a hammer 20. The frame is provided with a recess 22 in which a cylinder 24 is rotatably mounted. The rearward face of the cylinder 26 is aligned in opposition to a bolster face 28 integral to the frame. The cylinder 24 has circumferentially-spaced chambers 30 for receiving ammunition cartridges of a preselected caliber. The aft end of the barrel 14 includes a threaded section 15, as shown in FIG. 1A. FIG. 2 depicts the barrel 14 threadedly engaged 17 with the frame 12.

Figure 2A:
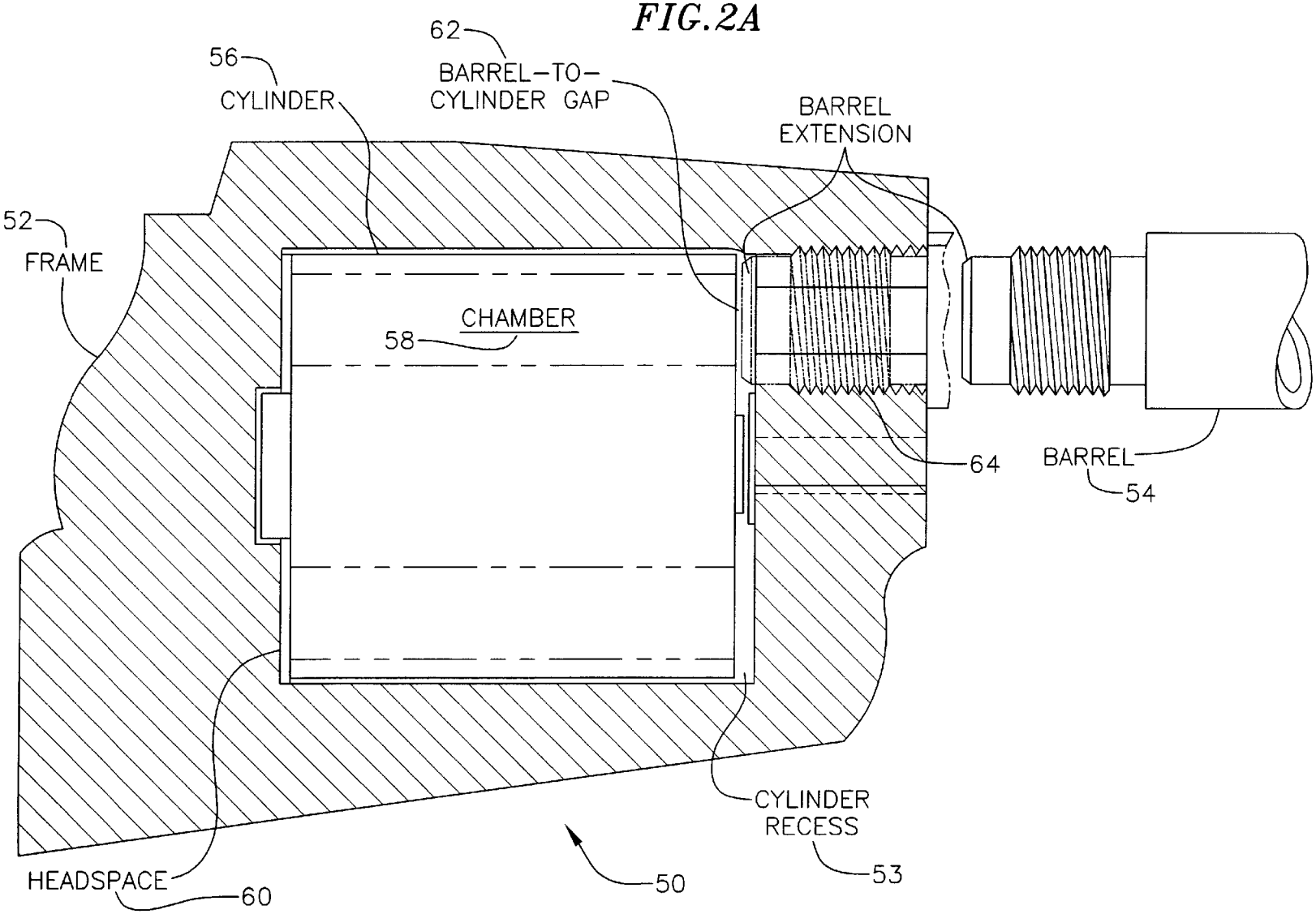
FIG. 2A shows cross section view of revolver spatial relationships.

The present invention provides a revolver 50 with a frame 52, having interchangeable barrels 54 and interchangeable cylinders 56 adapted to accept ammunition cartridges of differing caliber, as shown in FIG. 2A. The revolver 50 includes a tension ring (not shown) which locks a barrel 54 bored to a particular caliber into a predefined spatial relationship with a cylinder 56 of the me caliber. A predefined gap between the bolster face of the frame and the base of the ammunition cartridge held in a chamber 58 of the cylinder 56, called the headspace 60, also is maintained by the tension ring. In addition, the tension ring maintains a desired spacing between the barrel 54 and the cylinder 56, i.e., the barrel to cylinder gap 62. Preferred embodiments of the invention include unique barrel-cylinder combinations fit to differing headspace points within the frame.

Figure 2B:
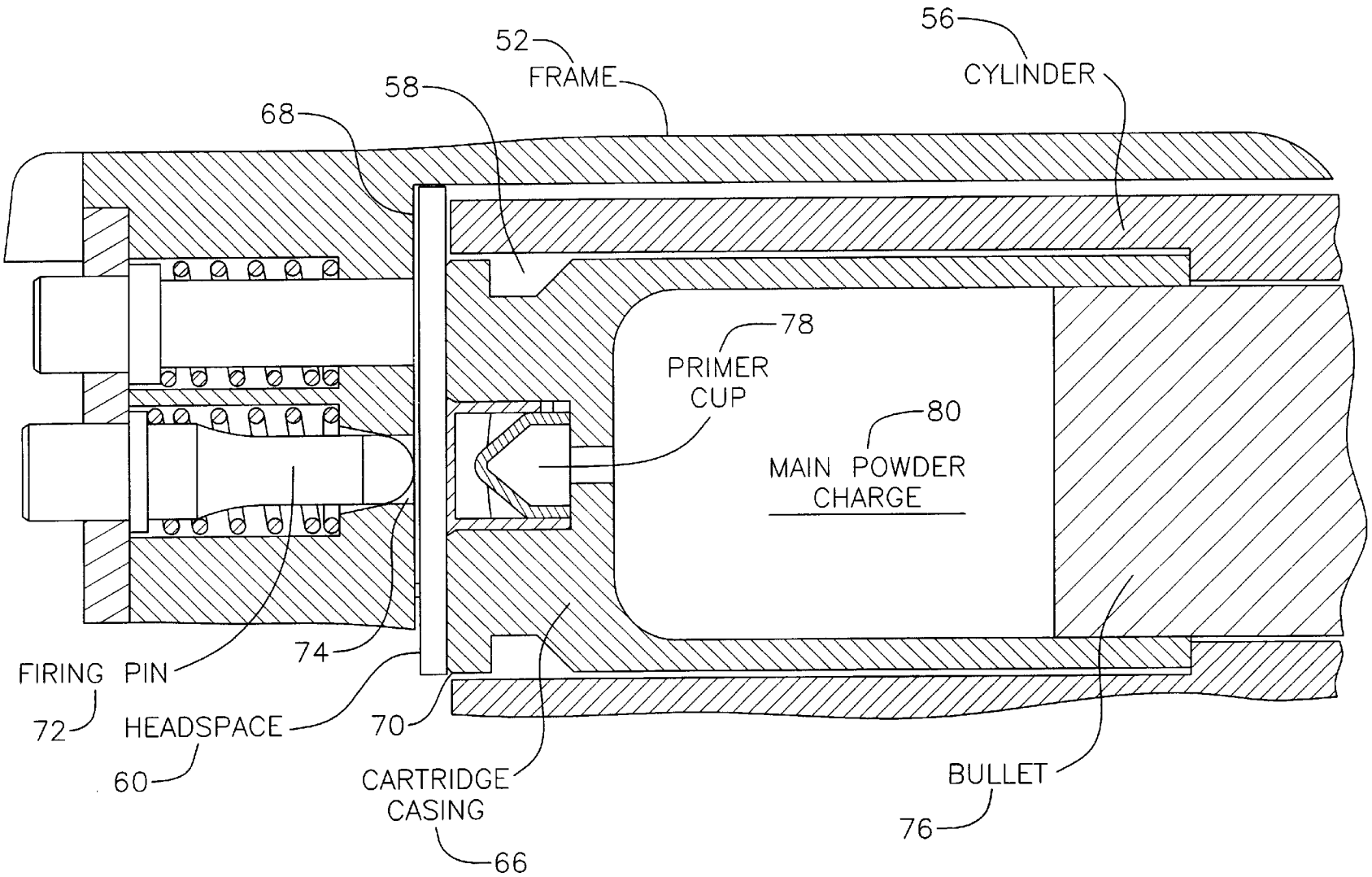
FIG. 2B shows close up cross section view of headspace spatial relationship.
Figure 3:
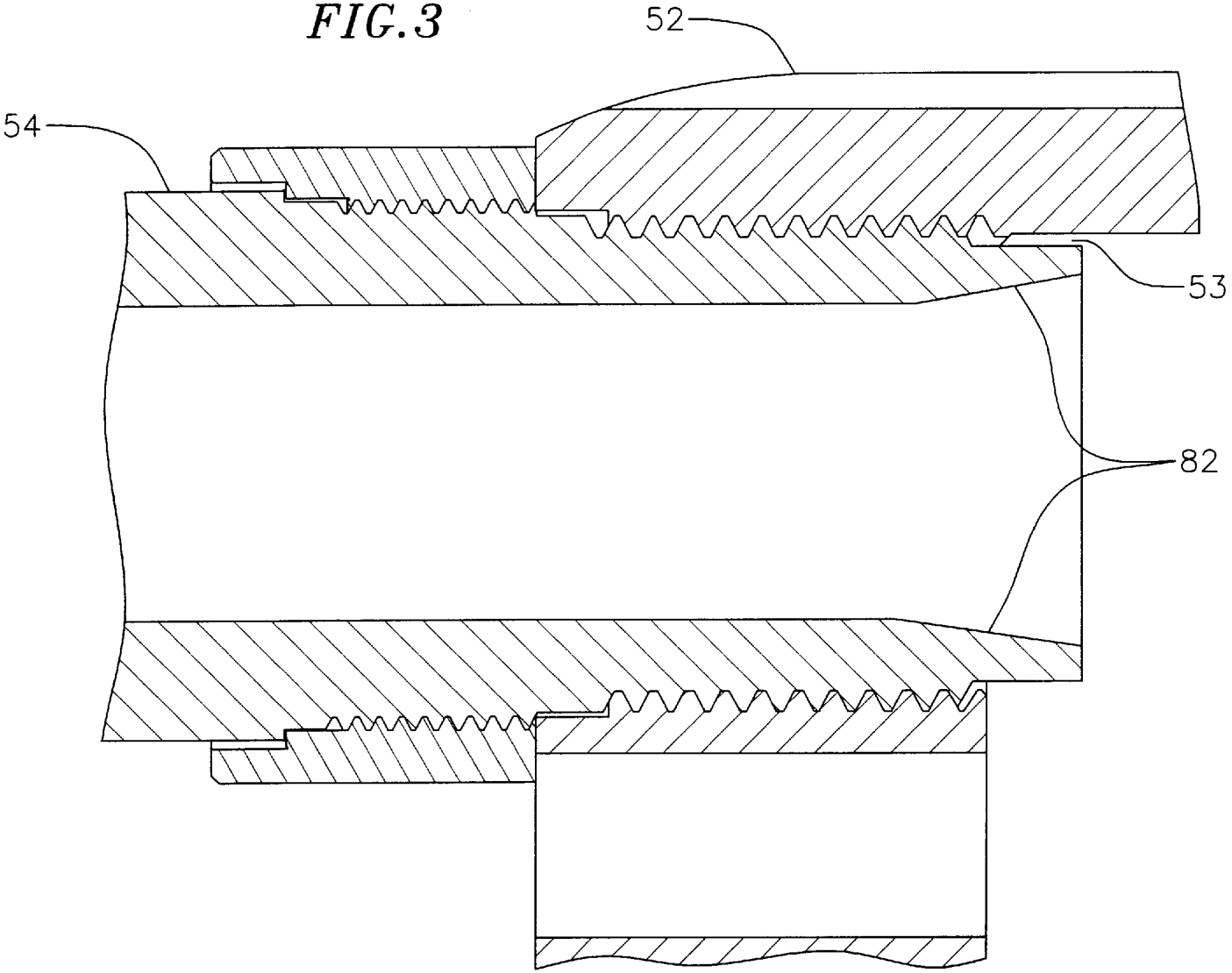
FIG. 3 is a sectioned view of new invention showing locking or tension ring installed.

FIG. 2A shows the barrel 54 threadedly engaged 64 through the frame 52, and held in a defined spatial relationship to the cylinder 56. FIG. 3 demonstrates that the inner bore of the aft end of the barrel 54, closest to the cylinder, is slightly flared to provide a forcing cone 82 for guiding the bullet portion of a cartridge into the barrel 54 upon firing, which forcing cone 82 slightly extends into the cylinder recess 53. The linear distance between the rearward edge of the barrel forcing cone 82 and the frontward face of the cylinder 56 is defined as the "barrel-to-cylinder gap 62," as illustrated by FIGS. 2A and 3. FIG. 2B demon rates that the aft end of each cartridge 66 has a base 70, which slightly protrudes from the aft end of the cylinder 56, limiting forward motion of the cartridge 66 in the cylinder chamber 58. The linear distance between the bolster face 68 and the rearward face of the cartridge casing base 70 is defined as the "headspace 60." Headspace is a function of caliber and, in general, the larger the caliber in use, the greater the headspace required.

Operation is illustrated using FIGS. 2A and 2B. Coupled with the hammer (not shown) and the trigger assembly (not shown) is the firing in 72, which is exposed to the cartridge through an aperture in the bolster face 74. Upon actuation of the trigger assembly, the cylinder 56 rotates, bringing a chamber 58 into selective registration with the barrel 54. The cartridge 66 within the selected chamber 58 is brought into coaxial alignment with the bore of the barrel 54, such that the bullet 76 of the cartridge 66 is aligned with the barrel 54, and the primer cup 78, disposed in the cartridge casing 66, is aligned with the firing pin 72. When the trigger is pulled, the hammer is urged to strike the firing pin 72 using conventional cocking and releasing mechanisms well-known in the art. The firing pin 72 then traverses the headspace 60 and strikes the cartridge primer cup 78. The perturbed primer cup 78, in turn, ignites the main powder charge 80 in the cartridge casing 66, rapidly generating a relatively large volume of gases. The expanding high-pressure gases displace the cartridge casing 66 rearwardly through the headspace 60 into engagement with the bolster face 68, and then drive the bullet 76 to the forcing cone and forwardly through the barrel 54.

It is important that the barrel-to-cylinder gap be properly dimensioned. If this gap is too small, the cylinder will not enter the frame recess. If the gap is too large, a significant amount of expanding gas and burning powder will escape, reducing the energy imparted to the bullet, and potentially injuring the shooter. However, the headspace is the most important dimension governing the safety of the shooter. When a firearm is fired, the cartridge tends to expand to the limits of the available volume within the chamber. If this volume is too great, as may be caused by too much headspace, the improperly supported cartridge expands excessively, and may rupture, seriously injuring the shooter. If there is to little headspace, the cylinder will not enter the frame recess, or if it does, it may cause damage to the firing pin.

For a single-caliber, fixed barrel revolver, dimensions such as headspace, and barrel-to-cylinder gap, typically are set at the factory. Unless adjusted by a gunsmith, or altered through use or damage, these spaces are rarely of import to a shooter. However, these dimensions, particularly headspace, must be properly and accurately adjusted when, as with the present invention, a revolver is adapted to accommodate ammunition of differing caliber and multiple barrel lengths. Cartridges for revolvers vary in length, primarily depending upon the caliber of the ammunition. Thus, the distance from the bolster face to the base of the cartridge, e.g., the headspace, when the cartridge is fully seated forwardmost in the chamber of the revolver cylinder, varies substantially from cartridge to cartridge.

A number of methods have been attempted for attaching different barrels, different cylinders, or both, to a firearm. One conventional technique is the so-called Savage barrel nut method employed by Savage Manufacturing Company, which is primarily intended for rifles and is well-known in the art. This involves employing a barrel set-nut having the same interior threads as the receiver, which threads are used to lock the barrel and action together in the correct relationship. However, because this method uses comparatively coarse barrel threads, it lacks the same degree of mechanical advantage possessed by other methods. In practice, a high degree of torque is required to lock together the barrel and action, making disassembly of the barrel and action difficult, and unsuitable for repeated, switch-barrel use. Additionally, such disassembly cannot take place with the action in the stock, due to the design of the locking barrel set nut. Thus, such an engagement system cannot accommodate the expedient switching of barrels of different caliber.

A conventional method of providing a firearm with multiple interchangeable barrels is shown in U.S. Pat. No. 4,288,938 (Kahn). Barrel installation is accomplished through conventional threads on the firearm's frame and barrel, modified only slightly, and secured by two set screws mounted perpendicular to the barrel's axis. However, recognizing that there must be clearance between the barrel threads and frame threads, such set screws when tightened act to thrust the barrel laterally within the frame, creating inconsistencies in a bullet's point of impact. The fact that U.S. Pat. No. 4,288,938 relies upon two set screws, each acting independently and in opposition to the other, means that there will be a large positional variation as to potential lock-ups, thus creating an unsatisfactory arrangement when accuracy is important. In addition, a related C-I-P patent, U.S. Pat. No. 4,297,801 (Kahn), a technique for providing a revolver employing multiple, interchangeable cylinders is described. Acknowledging that cylinders of different caliber can be of different lengths, this technique requires the use of barrels having a rearward extension to create a predetermined barrel-to-cylinder gap. In both U.S. Pat. No. 4,288,938, and related C-I-P patent, U.S. Pat. No. 4,297,801, the barrel-to-cylinder gap is the only caliber-related clearance that is addressed. There is no suggestion of how varying headspace requirements could be met by either invention.

A further technique disclosed in U.S. Pat. No. 5,020,260 (Houghton) includes a tensioning nut, but it does not have the benefit of seperate fine-pitch threads, relying instead on an extension of the standard barrel threads. Therefore, such a system lacks mechanical advantage and can be cumbersome for repeated barrel switches. In addition, the tensioning nut bears against a barrel bracket rather than the action itself, which design limits the available range of adjustment, making it unsuitable for fitting a cylinder of a particular caliber at a characteristic headspace point within a revolver frame. There is no teaching for adjusting headspace to accommodate ammunition cartridges, and cylinders, of different caliber, requiring different characteristic headspace.

U.S. Pat. No. 5,987,797 (Dustin) provides a rifle having the ability to accept a wide variety of interchangeable barrels of different caliber in a manner yielding a substantially invariant coaxial alignment of the receiver and barrel, by means of a rotatable, cylindrical locking ring, which is internally threaded with a series coaxially-aligned, fine-pitch "V" threads. The locking ring secures the barrel to the receiver at a threaded distal end of the receiver due to the torque exerted by the locking ring, which pulls the receiver and barrel toward a common center line. The substantially fine-pitch locking ring threads provide a maximized mechanical advantage upon rotation of the locking ring, which acts to sufficiently bind the receiver and barrel in substantially invariant coaxial alignment, without the requirement for excessive torque during tightening. This facilitates barrel exchange and provides the advantage of repeatable accuracy in firing with any given barrel. However, there is no teaching or suggestion of headspace adjustment, presumably because headspace in a rifle is achieved integrally to the barrel, in contrast with a revolver, where headspace is a function of caliber and is achieved independently of the barrel. Therefore, the disclosed technique is, in itself, lacking for applicability to revolvers.

Each of the aforementioned references is incorporated by reference in entirety herein.

Figure 4:
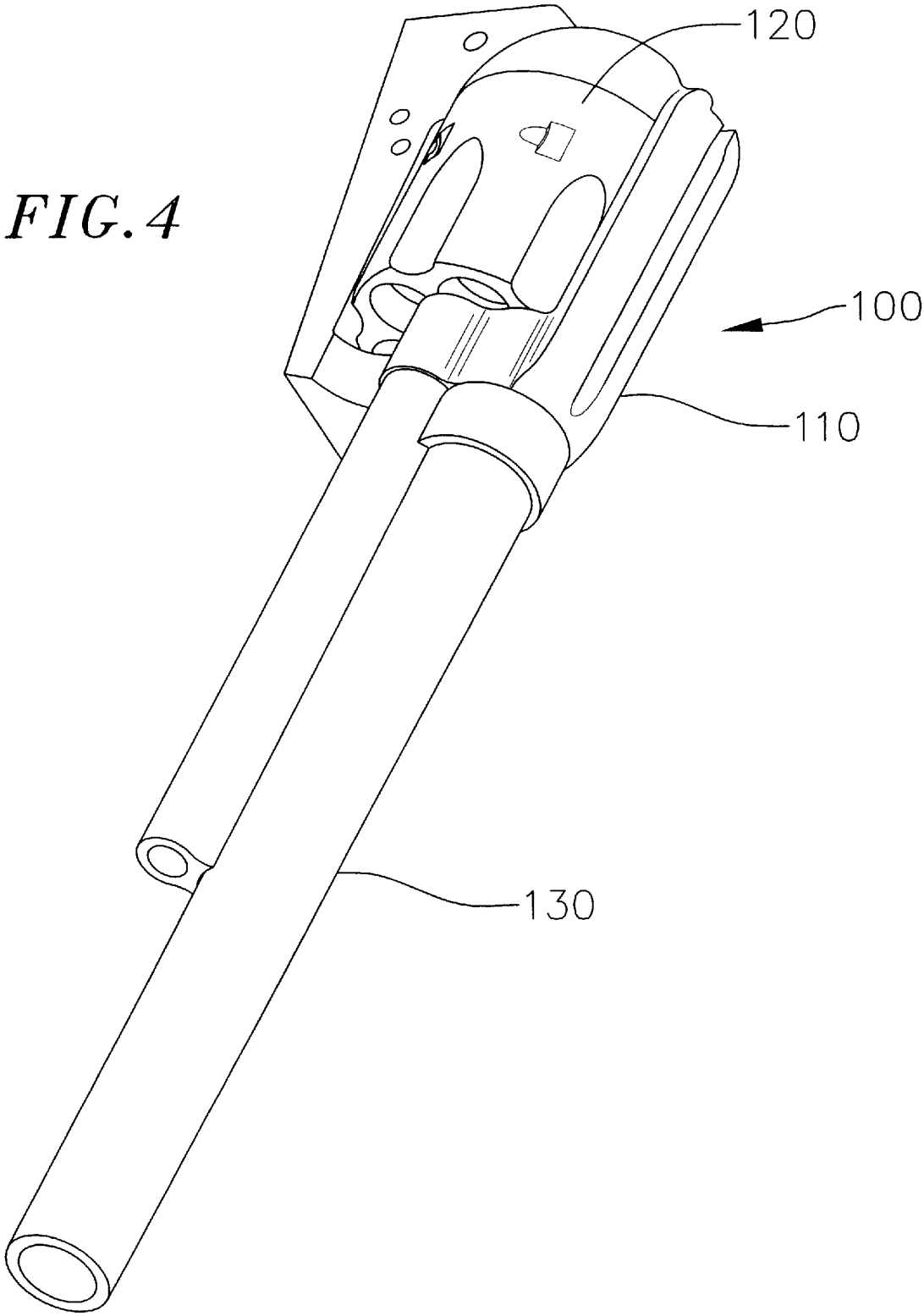
FIG. 4 is a complete assembly view of new design, showing barrel installed, ring installed and modification of ejector housing to accommodate locking ring.

FIG. 4 shows a revolver 100 according to the present invention, which essentially operates in the conventional manner described above. However, unlike techniques and apparatus found in the prior art, the invention herein provides an adaptable revolver that is capable of accommodating ammunition of differing caliber, for example, from .22 cal. to .45 cal., using the same revolver frame 110, yet providing the predetermined headspace characteristic of each different caliber, and maintaining a desirable barrel-to-cylinder gap. The adaptable revolver 100 includes one or more interchangeable cylinders 120, each adapted for a preselected caliber and each adapted to provide the predetermined headspace that is characteristic of the particular caliber. Also, the adaptable revolver includes one or more interchangeably barrels 130, each adapted for a preselected caliber and each adapted to cooperate with a corresponding interchangeable cylinder of a preselected caliber to provide a desirable barrel-to-cylinder gap. The respective lengths of a set of barrels 130 and cylinders 120 for a particular caliber can be uniquely defined, so that each may be exchanged with another set on the same frame 110.

Figure 6:
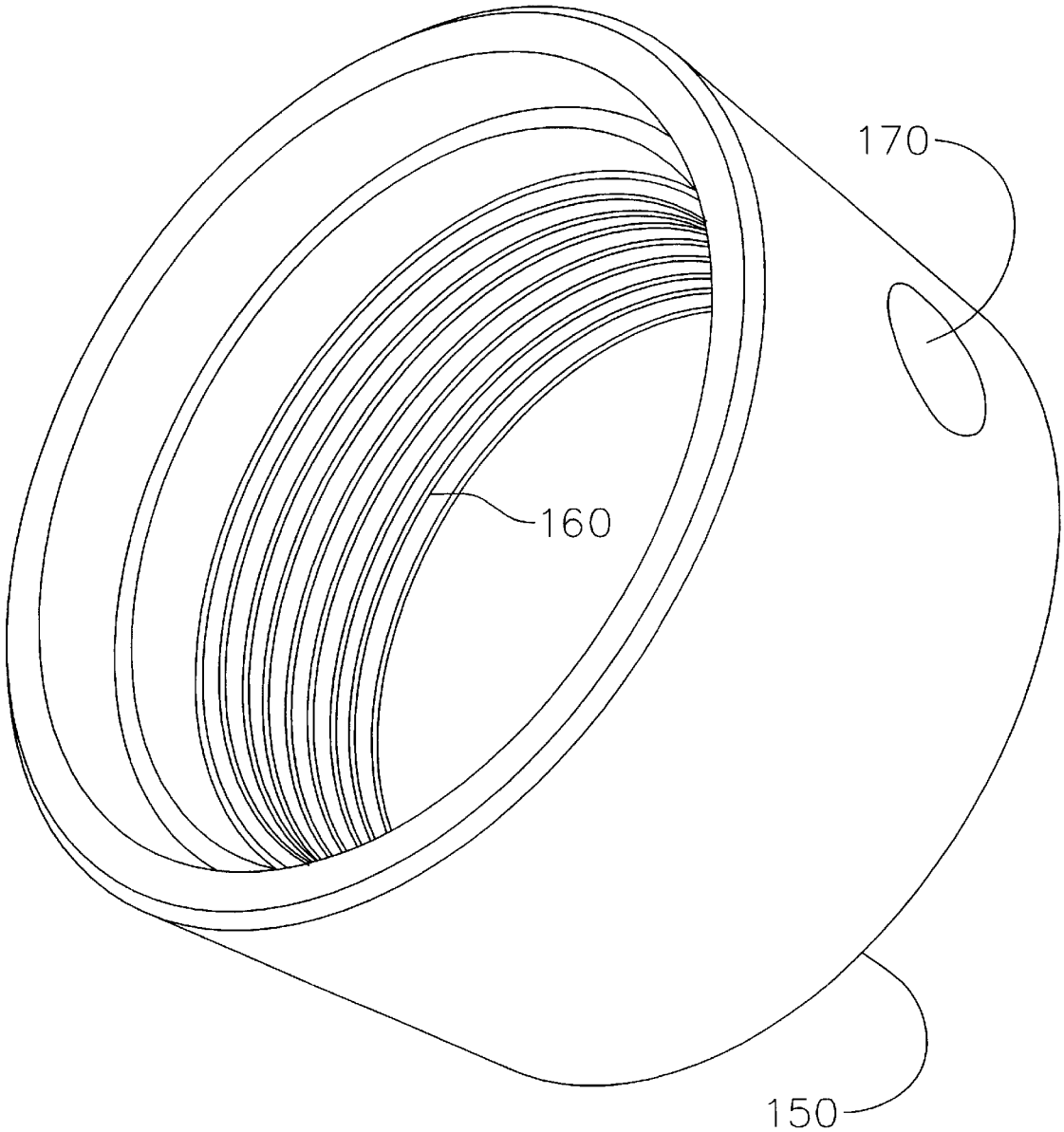
FIG. 6 is a locking ring showing tightening hole for wrench.

To achieve barrel-to-frame lock-up, the adaptable revolver uses a tension ring 150, as shown in FIG. 6. The tension ring 150 maintains the aforementioned predetermined headspace characteristic of the particular ammunition caliber in use, as well as the desired barrel-to-cylinder gap, thus accommodating the aforementioned interchangeable cylinders and interchangeable barrels.

Figure 5:
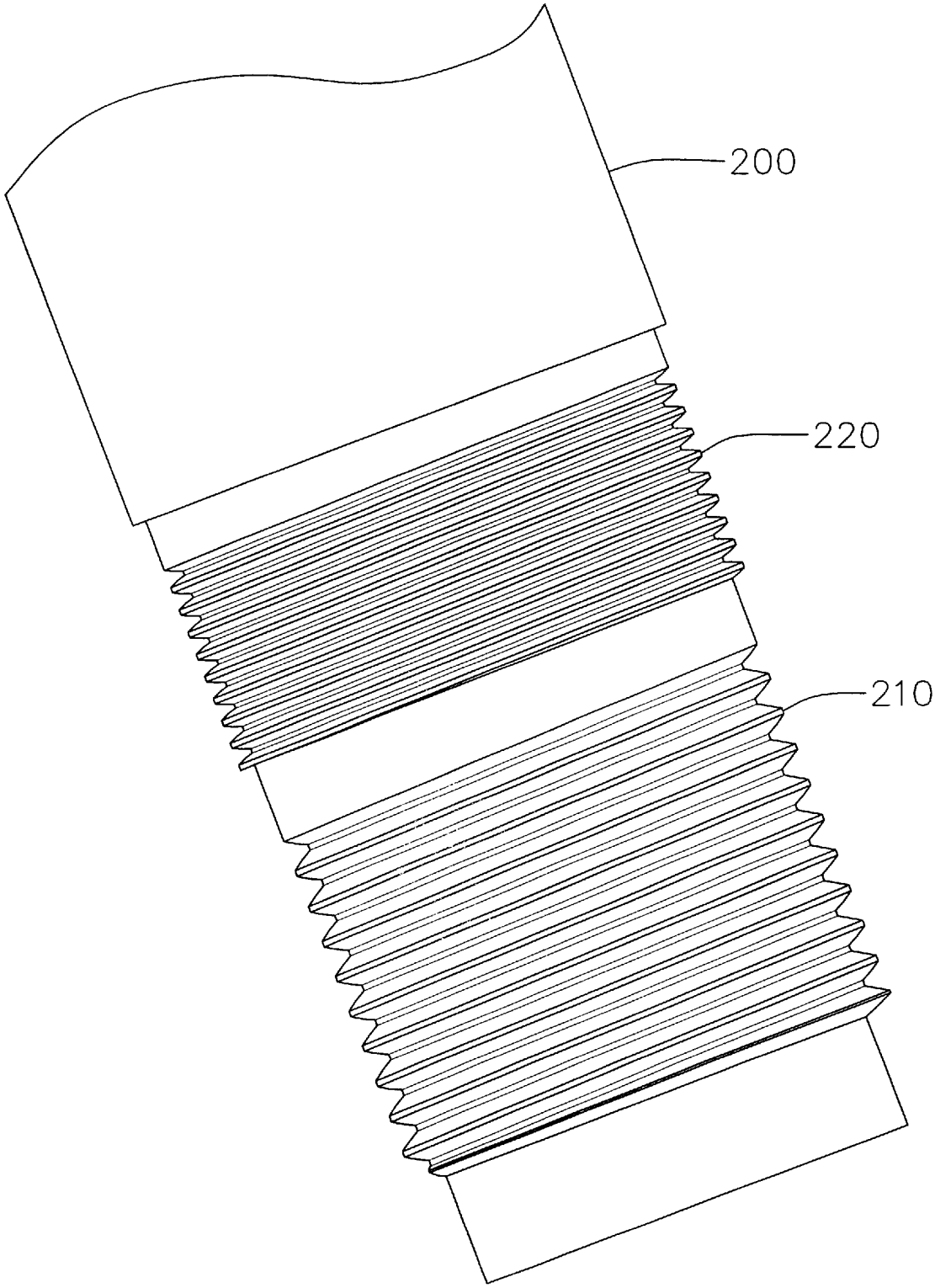
FIG. 5 is a modified barrel design showing new thread design for locking ring.
Figure 7:
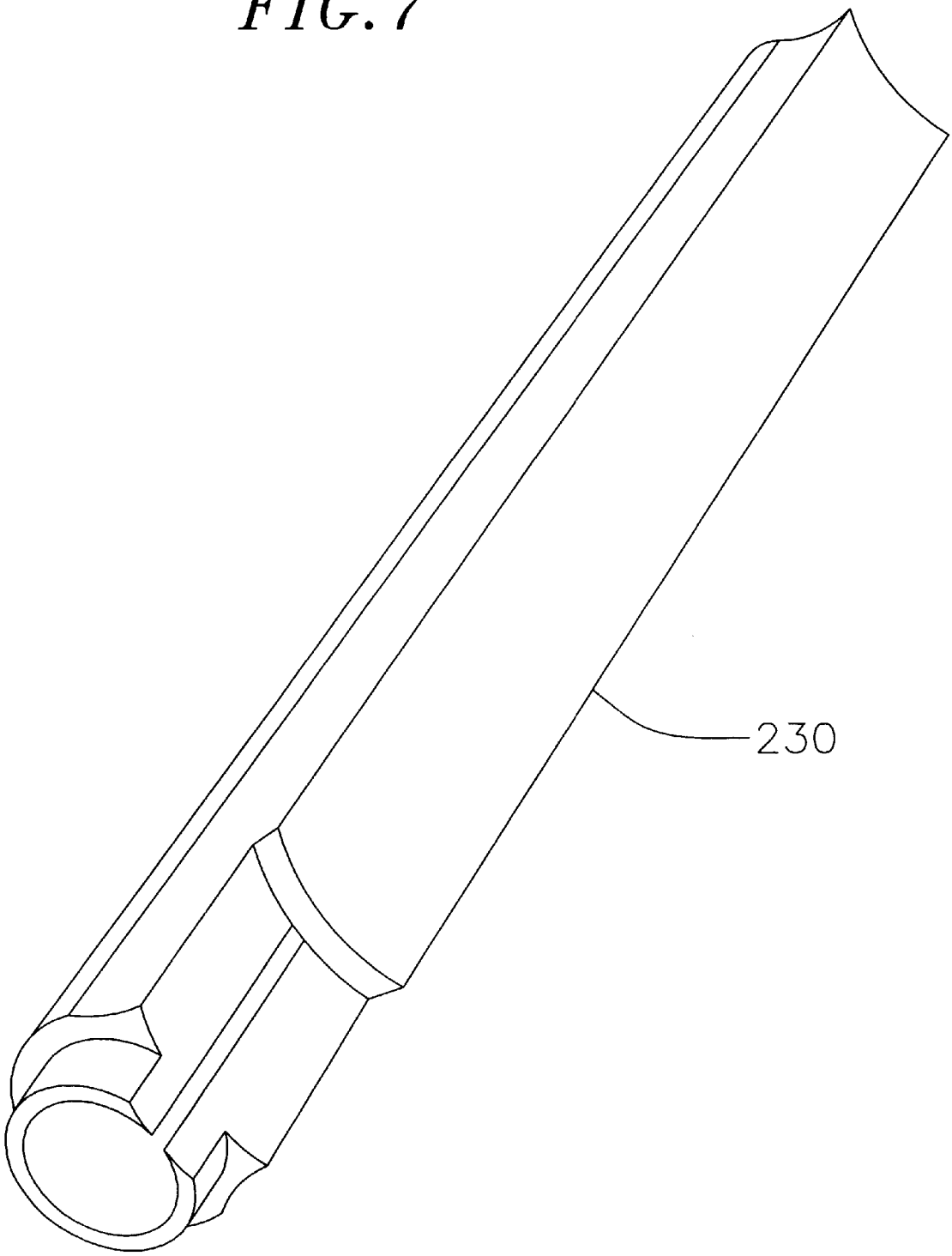
FIG. 7 is a modified ejector tube housing.
Figure 8:
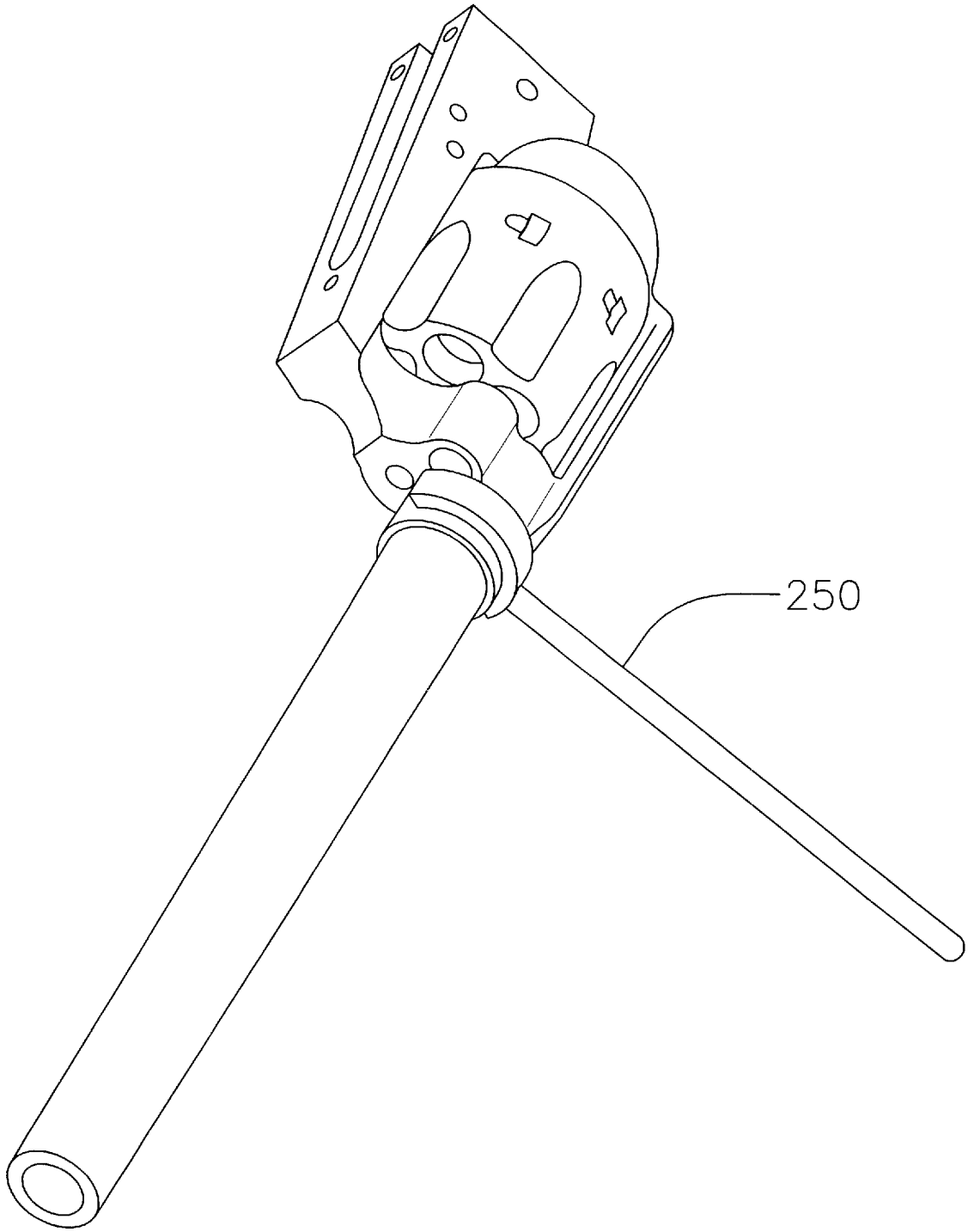
FIG. 8 is a tightening process shown with wrench installed.
Figure 9:
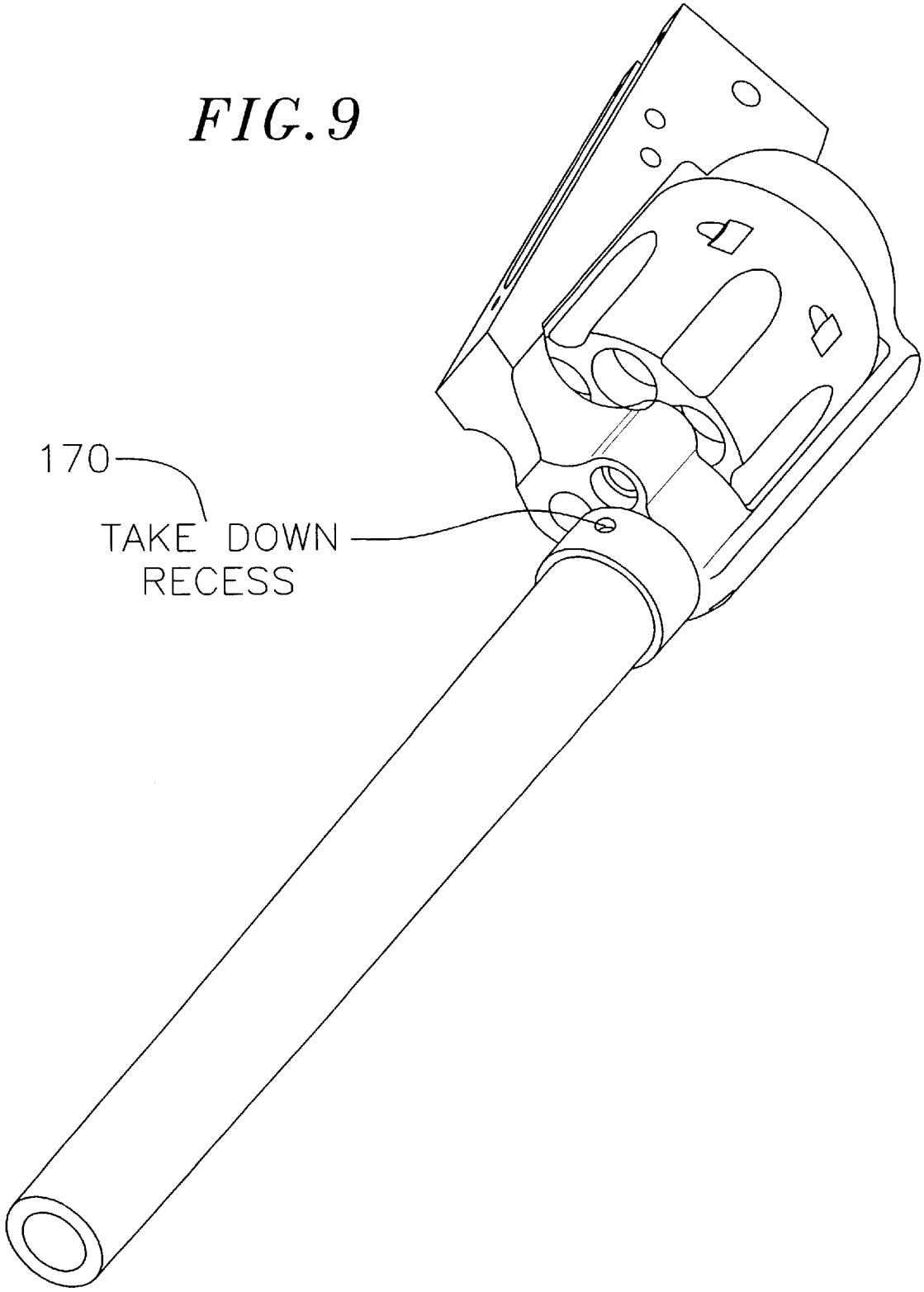
FIG. 9 shows an assembly with wrench removed after installation. Unsightly hole is hidden under ejector tube housing after replacement.

The tension ring 150 is internally threaded with a series of coaxially-aligned, fine-pitch "V" threads 160, and includes a take-down recess 170 which allows the ring to be rotated to effect revolver assembly or disassembly. As shown in FIG. 5, an interchangeable barrel 200 can have coarse- or medium-pitch threads 210 to engage the revolver frame, and fine-pitch threads 220 to engage the tension ring. Alternatively, the revolver frame can be internally threaded with a series of coaxially-aligned, fine-pitch "V" threads, allowing a uniform thread surface on the barrel (not shown) to couple the tension ring 150 and the revolver frame. Also, the adaptable revolver can include a modified ejector tube 230, adapted to couple with the tension ring 150, and suitable for facilitating the extraction of spent casings, as shown in FIG. 7. Furthermore, the present invention includes a take-down wrench 250 with a projection adapted to tightly engage the take-down recess 170 of the tension ring, as shown in FIGS. 8 and 9.

While this invention is described in connection with a preferred embodiment, it is to be understood that the invention is not limited to the disclosed embodiments. Upon examination of the disclosure above, it is readily apparent that modifications may be made to the revolver by one skilled in the art without departing from the nature or scope of the invention. Therefore, all equivalent embodiments and modifications are to be included within the scope of the following claims.

What is claimed is:

1. An adaptable revolver, comprising:

a. a revolver frame;

b. an interchangeable cylinder chambered to receive ammunition cartridges of a preselected caliber and rotatably mounted on the revolver frame with a predetermined headspace characteristic of the preselected caliber therebetween;

c. an interchangeable barrel bored to the preselected caliber and threadedly engaged through the revolver frame in a defined spatial relationship to the cylinder; and d. a tension ring adapted to threadedly engage the interchangeable barrel relative to the interchangeable cylinder and revolver frame such that the predetermined headspace is preserved.

2. The adaptable revolver of claim 1, wherein the tension ring further comprises a take-down recess adapted to receive a take-down wrench.

3. The adaptable revolver of claim 1, wherein the tension ring is internally threaded with coaxially-aligned, fine-pitch "V" threads, and the barrel is externally threaded with fine-pitch threads adapted to couple with the threads of the tension ring.

4. An adaptable revolver, comprising:

a. a revolver frame;

b. interchangeable cylinders chambered to receive ammunition cartridges of preselected calibers, each of the interchangeable cylinders being rotatably mounted on the revolver frame with a predetermined headspace therebetween, the predetermined headspace being characteristic of ones of the preselected calibers;

c. interchangeable barrels bored to the preselected calibers, each being threadedly engaged through the revolver frame in a defined spatial relationship to a selected one of the interchangeable cylinders of the same one of the preselected calibers; and d. a tension ring adapted to threadedly engage each of the interchangeable barrels relative to the selected one of the interchangeable cylinders such that the predetermined headspace is preserved.

5. The adaptable revolver of claim 4, wherein the tension ring is internally threaded with coaxially-aligned, fine-pitch "V" threads, and the barrel is externally threaded with fine-pitch threads adapted to couple with the threads of the tension ring.

6. The revolver of claim 4, wherein the tension ring further comprises a take-down recess adapted to receive a take-down wrench.

* * * * *